US006414589B1

(12) United States Patent
Angott et al.

(10) Patent No.: US 6,414,589 B1
(45) Date of Patent: Jul. 2, 2002

(54) APPARATUS FOR REMOTELY CONTROLLING AUXILIARY DOORBELL CHIME FROM DOORBELL PUSH BUTTON

(75) Inventors: Paul G. Angott, Bloomfield Hills; Thomas G. Xydis, Ann Arbor, both of MI (US)

(73) Assignee: Dimango Products Corporation, Brighton ( * ) Notice: Subject to any disclaimer, the term of this patent is extended or adjusted under 35 U.S.C. 154(b) by 862 days.

(21) Appl. No.: 08/920,652

(22) Filed: Aug. 15, 1997

Related U.S. Application Data

(63) Continuation of application No. 08/679,374, filed on Jul. 8, 1996, now abandoned.

(51) Int. Cl.[7] ..... G08B 27/00
(52) U.S. Cl. ..... 340/326; 340/384.7
(58) Field of Search ..... 340/326, 311.1, 340/384.6, 384.7, 385.37, 825.69, 825.71, 825.72; 348/155, 156; 358/108, 229

(56) References Cited

U.S. PATENT DOCUMENTS 3,017,623 A 1/1962 Bishofberger ..... 340/326
3,624,646 A * 11/1971 Weiss ..... 340/330
4,370,675 A * 1/1983 Cohn ..... 340/825.37
4,523,193 A * 6/1985 Levinson et al. ..... 340/326
4,524,384 A * 6/1985 Lefkowitz et al. ..... 358/108
5,428,388 A * 6/1995 Von Bauer et al. ..... 348/155

* cited by examiner

*Primary Examiner*—Van Thanh Trieu
(74) *Attorney, Agent, or Firm*—Howard & Howard

(57) ABSTRACT

An apparatus for activating a doorbell chime and for remotely controlling an auxiliary doorbell chime includes a push button unit responsive to manual actuation for activating the doorbell chime and generating a radio frequency wave and a remote unit responsive to the radio frequency wave for generating an auxiliary acoustic frequency wave. The push button unit has a manually actuated switch assembly with a first pair of normally open switch contacts adapted to be connected in series with the doorbell chime and a source of electrical power and a second pair of normally open switch contacts, a radio frequency transmitter connected in series with the second pair of switch contacts for generating a radio frequency output signal and a first antenna connected to the transmitter and responsive to the radio frequency output signal for generating the radio frequency wave. The remote unit has a second antenna responsive to the radio frequency wave for generating a radio frequency input signal, a radio frequency receiver connected to the second antenna and responsive to the radio frequency input signal for generating a generator activation signal, and an acoustic generator connected to the receiver and responsive to the generator activation signal for generating the auxiliary acoustic frequency signal. The acoustic generator can be a speaker and the push button unit can include a power supply connected across the first pair of normally open switch contacts for receiving charging current and connected to power the radio frequency transmitter.

7 Claims, 2 Drawing Sheets

APPARATUS FOR REMOTELY CONTROLLING AUXILIARY DOORBELL CHIME FROM DOORBELL PUSH BUTTON

This application is a File Wrapper Continuation of Ser. No. 08/679,374 filed Jul. 8, 1996, now abandoned.

BACKGROUND OF THE INVENTION

The present invention relates generally to doorbells and, in particular, to an apparatus for wireless communication with remotely located auxiliary doorbell chimes.

Many devices for generating remote signals are known. The U.S. Pat. No. 4,430,652 shows a remote control system for causing an audible signal to be produced at a remote location. The system includes a manual signal switch that causes a transmitter to produce a manually encoded radio frequency signal, which signal is received by a receiver. The receiver is coupled with signal decoding and processing circuitry to appropriately operate a signalling device, such as a whistle typically used in the logging industry.

The U.S. Pat. No. 4,523,193 shows a radio frequency transmitter that communicates with a remote receiver. The transmitter is wired across a doorbell and is activated when power is applied to ring the doorbell.

The U.S. Pat. No. 4,912,463 shows a remote control apparatus having a transmitter and a receiver. The transmitter communicates with the receiver by a radio frequency signal, which signal can be varied according to the position of a switch in the transmitter. The position of the switch dictates the mode of operation of the transmitter. The transmitter is activated by a push button switch.

The U.S. Pat. No. 3,017,623 shows a doorbell and porch light control circuit for turning on a porch light at the same time as activating a doorbell. When the doorbell button is pressed, a circuit is closed and the doorbell chime is activated. A relay coil is energized, which causes a relay switch to move into contact with a lead. Once the switch contacts the lead, the circuit for energizing the light is closed and the light turns on. A bi-metal operated switch is shown that acts as a timer for eventually turning off the power to the light a selected amount of time after the doorbell button was pressed.

SUMMARY OF THE INVENTION

The present invention concerns an apparatus for activating a doorbell chime and for remotely controlling an auxiliary doorbell chime. The apparatus includes a push button unit adapted to be connected to a doorbell chime and a source of electrical power and being responsive to manual actuation for activating the doorbell chime from the source of electrical power and for generating a radio frequency wave and a remote unit being responsive to the radio frequency wave for generating an auxiliary acoustic frequency wave representing manual actuation of the push button unit.

The push button unit has a manually actuated switch assembly with a first pair of normally open switch contacts adapted to be connected in series with the doorbell chime and the source of electrical power and a second pair of normally open switch contacts, a radio frequency transmitter connected in series with the second pair of contacts, the second pair of contacts and the radio frequency transmitter adapted to be connected in series with the doorbell chime and the source of electrical power for generating a radio frequency output signal at an output of the transmitter and a first antenna connected to the transmitter output and being responsive to the radio frequency output signal for generating the radio frequency wave. The remote unit has a second antenna responsive to the radio frequency wave for generating a radio frequency input signal, a radio frequency receiver having an input connected to the second antenna and being responsive to the radio frequency input signal for generating a generator activation signal and an acoustic generator having an input connected to the receiver output and being responsive to the generator activation signal for generating the auxiliary acoustic frequency signal.

The acoustic generator can be a speaker for generating the auxiliary acoustic frequency wave. Furthermore, the push button unit can include a power supply connected across the first pair of contacts for receiving charging current and having a power output, the radio frequency transmitter can have a power input connected to the power output and an activation input connected to one contact of the second pair of contacts, and another contact of the second pair of contacts can be adapted to be connected to the source of electrical power whereby the power source provides power for generating the radio frequency output signal.

The apparatus according to the present invention has the advantage that it replaces the existing doorbell and does not require any other electrical connection to the existing doorbell chime.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
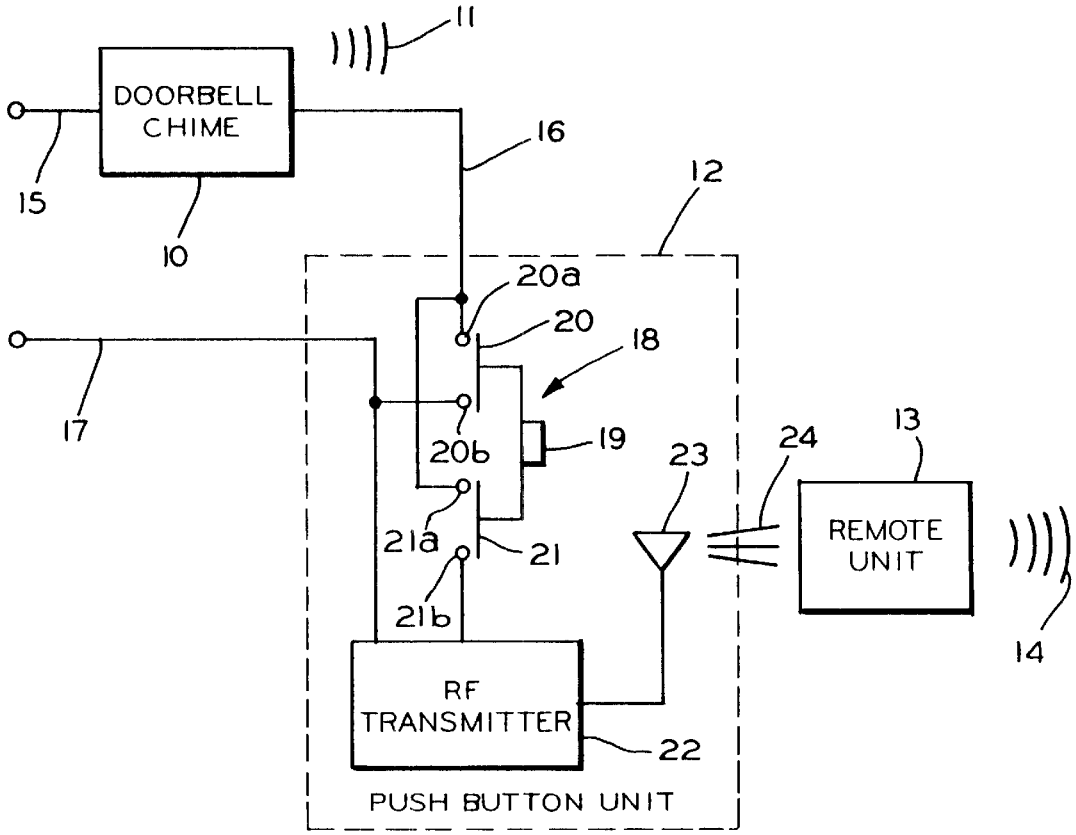
FIG. 1 is a block schematic diagram of an auxiliary doorbell apparatus in accordance with the present invention.

There is shown in the FIG. 1 a block schematic diagram of an auxiliary doorbell apparatus in accordance with the present invention. An existing hardwired doorbell system includes a doorbell chime 10 which is typically mounted on a wall in a house or a building and is electrically coupled to the building electrical supply (not shown). Upon activation, the doorbell chime 10 emits a sound at one or more known frequencies which sound travels through the house or building as a source acoustic frequency wave 11. The chime 10 typically is connected in a circuit with a transformer and a push button switch operated by a person seeking admittance to the house or building. When the doorbell switch is closed, an electrical current passes through the transformer primary winding and induces another electrical current in the transformer secondary winding to power the chime causing the emission of the source acoustic frequency wave 11. Typically, the chime 10 is located near the door at which the push button switch is mounted. Often, it is desirable to have additional locations for a chime since the acoustic wave 11 diminishes in volume as it travels from the immediate area of the chime and often cannot be heard in other rooms or areas outside of the building, such as the backyard of a residence or a garage.

According to the present invention, a push button unit 12 replaces the conventional push button for simultaneously activating the doorbell chime 10 to generate the source acoustic frequency wave 11 and activating a remote unit 13 to generate an auxiliary acoustic frequency wave 14. The doorbell chime 10 has an input connected to a first power line 15 which is typically connected to a "hot" power line (not shown) in the building wiring. An output of the doorbell chime 10 is connected by a line 16 to an input of the push button unit 12. An output of the push button unit 12 is connected to a second power line 17 which in turn is connected to a "neutral" line (not shown) in the building wiring. The push button unit 12 includes a push button switch assembly 18 having a manually actuated push button 19 mechanically coupled to a first normally open switch 20 and a second normally open switch 21. The switches 20 and 21 are of the type that are closed by pressure applied to the push button 19 and are automatically opened upon removal of the pressure. The first switch 20 has a pair of contacts 20*a* and 20*b*. The contact 20*a* is connected to the line 16 and the contact 20*b* is connected to the second power line 17. Upon application of pressure to the push button 19 to close the switch 20, an electrical circuit is completed through the first power line 15, the doorbell chime 10, the line 16, the push button unit 12 and the second power line 17 to energize the doorbell chime and generate the source acoustic frequency wave The second switch 21 also has a pair of contacts 21*a* and 21*b*. The contact 21*a* is connected to the line 16 and the contact 21*b* is connected to an input of a radio frequency transmitter 22 in the push button unit 12. The transmitter 22 has an output connected to the second power line 17 such that when the switch 21 is closed, an electrical circuit is completed through the first power line 15, the doorbell chime 10, the line 16, the switch 21, the transmitter 22 and the second power line 17 to activate the transmitter. The transmitter 22 has an output connected to a first antenna 23. Upon activation, the transmitter 22 generates a radio frequency output signal to the antenna 23 which generates a radio frequency wave 24. A second antenna 25 is connected to an input of the remote unit 13. The second antenna 25 receives the radio frequency wave 24 and generates a radio frequency input signal to the remote unit 13 which responds by generating the auxiliary acoustic frequency wave 14. Upon removal of the pressure from the push button 19, both switches 20 and 21 open to remove electrical power from the doorbell chime 12 and the transmitter 22.

Figure 2:
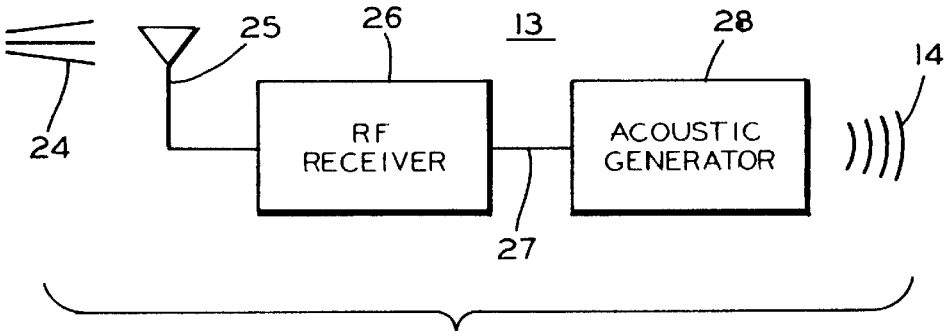
FIG. 2 is a block schematic diagram of the remote unit shown in the FIG. 1.

The remote unit 13 can be mounted at any desired location limited only by the ability to detect the radio frequency wave 24. As shown in the FIG. 2, the remote unit 13 includes a radio frequency receiver 26 having an input connected to the second antenna 25. The receiver 26 has an output connected by a line 27 to an input of an acoustic generator 28. Upon receiving the radio frequency input signal from the antenna 25, the receiver 26 generates a generator activation signal on the line 27. The acoustic generator 28 responds to the generator activation signal by generating the auxiliary acoustic frequency wave 14.

Figure 3:
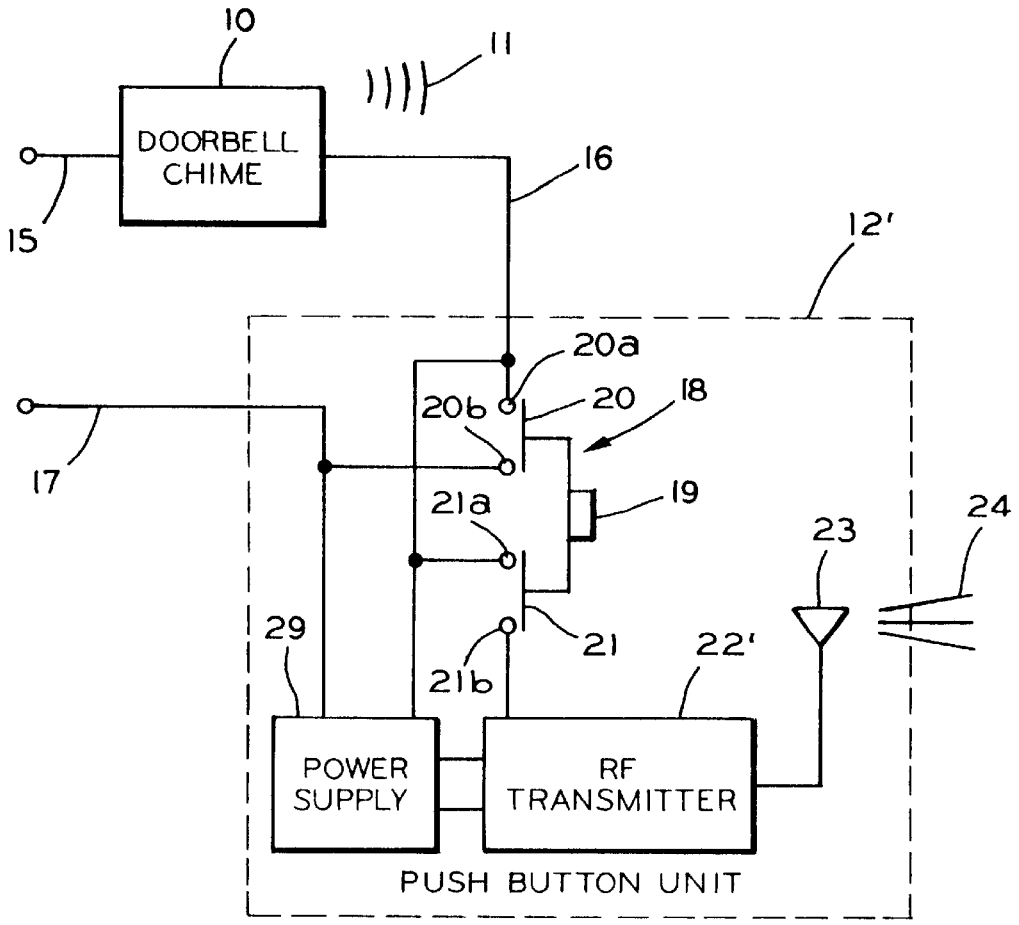
FIG. 3 is a block schematic diagram of an alternate embodiment of an auxiliary doorbell apparatus in accordance with the present invention.

According to the present invention, an alternate embodiment push button unit 12' is shown in the FIG. 3. The push button unit 12' replaces the conventional push button for simultaneously activating the doorbell chime 10 to generate the source acoustic frequency wave 11 and activating the remote unit 13 (shown in the FIGS. 1 and 2) to generate the auxiliary acoustic frequency wave 14. The push button unit 12' includes the push button switch assembly 18 shown in the FIG. 1. The contact 21*b* of the second switch 21 is connected to an activation input of a radio frequency transmitter 22' in the push button unit 12'. The contact 21*a* is connected to a terminal of a power supply 29 in the push button unit 12'. The power supply 29 can include a rechargeable battery and charging circuit and has another terminal connected to the second power line 17. Thus, the power supply can receive a continuous charging current, typically a "trickle charge", between activations of the doorbell chime 10. The power outputs of the power supply 29 are connected to power inputs of the transmitter 22' such that when the switch 21 is closed, an activation signal is generated to turn on the transmitter 22' which draws power from the power supply 29 to generate the radio frequency output signal to the antenna 23 which generates the radio frequency wave 24.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for activating a doorbell chime and remotely controlling an auxiliary doorbell chime comprising:

a push button unit for replacing a doorbell switch connected in series with a doorbell chime in an existing doorbell system, said push button unit adapted to be located at a first location at which the doorbell switch to be replaced is mounted and adapted to be connected in series with the doorbell chime to a pair of electrical power lines;

a push button switch assembly in said push button unit, said push button switch assembly including a pair of first and second normally open and electrically independent switches and a manually actuated push button mechanically coupled to said pair of first and second switches, respectively, for simultaneously moving said first and second switches in response to movement of said push button, said first switch adapted to be connected in series with the doorbell chime to the power lines;

a radio frequency transmitter in said push button unit for generating a radio frequency wave and being connected in series with said second switch, said transmitter and said second switch adapted to be connected in series with the doorbell chime; and a remote unit adapted to be located at a second location remote from the first location and being responsive to said radio frequency wave for generating an auxiliary acoustic frequency wave representing manual actuation of said push button whereby when the power lines are connected to a source of electrical power and the doorbell chime and said push button unit are connected in series with the power lines, manual actuation of said push button simultaneously closes said switches to energize the doorbell chime and generate a source acoustic wave at the first location and activates said transmitter to generate said auxiliary acoustic frequency wave from said remote unit.

2. The apparatus according to claim 1 wherein said radio frequency transmitter generates a radio frequency output signal at an output and said push button unit includes an antenna connected to said transmitter output and being responsive to said radio frequency output signal for generating said radio frequency wave.

3. The apparatus according to claim 1 wherein said remote unit includes an antenna responsive to said radio frequency wave for generating a radio frequency input signal and said radio frequency receiver has an input connected to said antenna and is responsive to said radio frequency input signal for generating said generator activation signal.

4. The apparatus according to claim 1 wherein said acoustic generator is a speaker.

5. The apparatus according to claim 1 wherein said push button unit includes a power supply connected across said first switch for receiving charging current and having a power output, said radio frequency transmitter having a power input connected to said power output of said power supply, said radio frequency transmitter having an activation input connected to said second switch.

6. An apparatus for activating a doorbell chime and remotely controlling an auxiliary doorbell chime comprising:

a push button unit for replacing a doorbell switch connected in an electrical power line in series with a doorbell chime in an existing doorbell system, said push button unit adapted to be located at a first location at which the doorbell switch to be replaced is mounted and adapted to be connected in series with the doorbell chime to a pair of electrical wires;

a push button switch assembly in said push button unit, said push button switch assembly including a pair of first and second normally open and electrically independent switches and a manually actuated push button mechanically coupled to said first and second switches, respectively, for simultaneously moving said first and second switches in response to movement of said push button, said first switch adapted to be connected in series with the doorbell chime to the power lines;

a radio frequency transmitter in said push button unit for generating a radio frequency wave and being connected in series with a second one of said switches, said transmitter and said second switch adapted to be connected in series with the doorbell chime;

a remote unit adapted to be located at a second location remote from the first location and being responsive to said radio frequency wave for generating an auxiliary acoustic frequency wave representing manual actuation of said push button;

a radio frequency receiver in said remote unit responsive to said radio frequency wave for generating a generator activation signal at an output; and an acoustic generator in said remote unit having an input connected to said receiver output and being responsive to said generator activation signal for generating said auxiliary acoustic frequency wave whereby when the power lines are connected to a source of electrical power and the doorbell chime and said push button unit are connected in series with the power lines, manual actuation of said push button simultaneously closes said switches to energize the doorbell chime and generate a source acoustic wave at the first location and activates said transmitter to generate said auxiliary acoustic frequency wave from said remote unit.

7. A method for adding an auxiliary doorbell chime to an original doorbell chime having an original switch which is connected to house electrical power by replacing the original switch to remotely control an auxiliary doorbell chime comprising the steps of:

positioning a radio frequency transmitter adjacent the original switch for transmitting a radio signal in response to electrical power;

positioning a radio frequency receiver at a position remote from the original chime for receiving the radio signal from the radio frequency transmitter and generating an acoustic generator signal in response thereto;

generating an auxiliary sound wave defining an auxiliary audio chime in response to the acoustic generator signal;

removing the original switch from the electrical power line;

said method characterized by placing a push button switch, having first and second normally open and electrically independent switches and a single manually actuated push button mechanically coupled to the first and second switches, in substitution for the original switch; and connecting the first switch in series with the chime power line to electrically energize the original chime and connecting the second switch in series with the radio frequency transmitter and the power line whereby, when the first and second switches are connected in series with the power line, manual actuation of the single push button simultaneously closes the first and second switches to energize the doorbell chime and activate the transmitter to generate the auxiliary sound wave defining an auxiliary audio chime in response to the acoustic generator signal from the receiver.

* * * * *